US012740646B2

(12) United States Patent
Bertolini et al.

(10) Patent No.: US 12,740,646 B2
(45) Date of Patent: Sep. 22, 2026

(54) ADAPTABLE SEAT

(71) Applicant: OMP S.R.L., Castello di Godego (IT)

(72) Inventors: Emanuele Bertolini, Piazzola sul Brenta (IT); Paolo Scagnellato, Padua (IT); Jeremiah Ferrarese, Padua (IT)

(73) Assignee: OMP S.R.L., Castello di Godego (IT)

( * ) Notice: Subject to any disclaimer, the term of this patent is extended or adjusted under 35 U.S.C. 154(b) by 168 days.

(21) Appl. No.: 18/557,058

(22) PCT Filed: Apr. 28, 2022

(86) PCT No.: PCT/IB2022/053963

§ 371 (c)(1),
(2) Date: Oct. 25, 2023

(87) PCT Pub. No.: WO2022/229901

PCT Pub. Date: Nov. 3, 2022

(65) Prior Publication Data

US 2024/0206626 A1 Jun. 27, 2024

(30) Foreign Application Priority Data

Apr. 28, 2021 (IT) ..... 102021000010778

(51) Int. Cl.
*A47C 3/04* (2006.01)
*A47C 7/44* (2006.01)
*A47C 7/46* (2006.01)

(52) U.S. Cl.
CPC ..... *A47C 7/462* (2013.01); *A47C 7/44* (2013.01); *A47C 3/04* (2013.01)

(58) Field of Classification Search
CPC ..... A47C 7/44; A47C 7/462; A47C 3/04
USPC ..... 297/341, 342
See application file for complete search history.

(56) References Cited

U.S. PATENT DOCUMENTS 2,634,796 A 4/1953 Fischer
3,536,358 A * 10/1970 Masucci ..... A47C 1/032 297/342
3,724,896 A * 4/1973 Belk ..... B60N 2/143 297/342 X (Continued)

FOREIGN PATENT DOCUMENTS

EP 2165627 A1 8/2009
GB 2429405 A 8/2006

(Continued)

*Primary Examiner* — Rodney B White
(74) *Attorney, Agent, or Firm* — Carmel Patent Agency; Robert Ballarini

(57) ABSTRACT

An adaptable seat includes a frame, a backrest member and a seat member. The backrest member is rotatably connected to the frame about a rotation axis, and the seat member comprises a sliding mechanism which includes at least one linear guide which connects the seat member to the frame and allows said seat member to move along a sliding axis. The adaptable seat also includes a connection mechanism which connects the backrest member to the seat member and includes a male element and a female element which are formed on the seat member and the backrest member, respectively, or vice versa, and which are capable of mutual engagement in such a manner as to convert a rotation of the backrest member into a sliding action of the seat member, and vice versa.

22 Claims, 8 Drawing Sheets

(56) References Cited

U.S. PATENT DOCUMENTS

| | | | | |
|---|---|---|---|---|
| 3,863,980 | A * | 2/1975 | Ciner | A47C 1/035 297/342 X |
| 6,863,346 | B2 * | 3/2005 | Zund | A47C 1/03272 297/322 X |
| 6,923,503 | B2 * | 8/2005 | Sangiorgio | A47C 1/03272 297/342 X |
| 7,048,335 | B2 * | 5/2006 | Norman | A47C 7/46 297/342 X |
| 8,474,912 | B2 * | 7/2013 | Lockwood | A47C 1/03272 297/342 X |
| 9,462,889 | B2 * | 10/2016 | Piretti | A47C 1/03255 |
| 2011/0084530 | A1 | 4/2011 | Lockwood et al. | |
| 2014/0361588 | A1 * | 12/2014 | Romero | A47C 1/03294 297/341 |
| 2015/0076876 | A1 | 3/2015 | Hasegawa et al. | |
| 2015/0359338 | A1 * | 12/2015 | Romero | A47C 1/03261 297/341 |

FOREIGN PATENT DOCUMENTS

| | | | |
|---|---|---|---|
| JP | H0274213 | A | 3/1990 |
| JP | 2011161123 | A | 8/2011 |
| KR | 102072935 | B1 | 2/2020 |

* cited by examiner

ADAPTABLE SEAT

FIELD OF THE INVENTION

The present invention relates to a seat of the kind that may be used in schoolrooms, conference rooms, open-air cinemas or theatres and the like.

In particular, the present invention relates to a seat of the kind intended for collective spaces, i.e. a kind of seats which are intended to be used all together in large numbers, are preferably inexpensive, are preferably also light if not fixed in place, take up little space and are typically easy to stack.

BACKGROUND

Within this sector, there is a need to be able to ensure a particular level of comfort for the user, both in a standard sitting condition for frontal viewing and, for example, when viewing a raised screen or actors on a raised stage.

A number of solutions to this need have been developed that are intended to make the seats adaptable so as to allow the user to maintain support for their spine and in particular the lumbar region, even when said user assumes positions that require the back and the neck to be inclined, for example in order to be able to follow a film, a debate or a show.

One example of this type of collective seat is described in British patent application GB2429405A, which relates to a chair composed solely of the seat member, the backrest member and the mechanism for the mobility of the chair which we will call seat), as well as the various types of frame to which the seat may be secured. Furthermore, the seat represents the framework of the chair and may be covered according to need.

The chair comprises a series of mechanisms that allow it to be adapted to the seating requirements of the user. Disadvantageously, these mechanisms make the design of the seat particularly complex, which makes it unsuitable for use as a collective seat, especially if not fixed in place. Moreover, the chair is not optimised in terms of lightness, stackability and compactness.

A further example of this type of collective seat is described in the European patent application EP2165627A1, which relates to a seat having a resilient connection between the backrest member and the seat member that allows the backrest member to flex when subjected to the force exerted by a load (the seated person). Even though the seat is a collective seat which has simple lines and is light and compact, it does not comprise any mechanism for sliding the seat member, let alone any mechanism that allows the seat member to slide simultaneously with the inclination of the backrest member.

Further examples of seats comprising inclinable backrest members are described in JPH0274213A, US627898, US2011/084530, JP2011/161123 and US2015/076876.

Therefore, the problem addressed by the present invention is that of providing a collective seat that may be adapted to the comfort and sitting conditions of the user and that overcomes one or more of the drawbacks mentioned with reference to the prior art.

SUMMARY

One aim of the present invention is that of providing an adaptable seat comprising a seat member and a backrest member which allow the inclination of the backrest member to be adapted in a simultaneous and coordinated manner with the horizontal sliding action of the seat member.

Another aim of the invention is that of providing an adaptable seat that achieves the above aim of being simple, light, stackable, easy to construct and inexpensive.

A further aim is that of providing an adaptable seat wherein the seat member and the backrest member may be adjusted in a coordinated manner without using complex mechanisms or mechanical elements.

This problem is solved and these aims are achieved by an adaptable seat as described above which comprises a frame, a backrest member and a seat member. Said backrest member is preferably rotatably connected to the frame about a rotation axis x. Said seat member preferably comprises a sliding mechanism comprising at least one linear guide which connects the seat member to the frame and allows the movement thereof along a sliding axis defined by said linear guide.

Said adaptable seat also comprises a connection mechanism which connects said backrest member to said seat member. Said connection mechanism preferably comprises a male element and a female element which are formed on said seat member and said backrest member, respectively, or vice versa, and which are capable of mutual engagement in such a manner as to convert a rotation of the backrest member about the rotation axis into a sliding of the seat member along the sliding axis x, and vice versa.

The main advantage of the invention is that the connection mechanism between the seat member and the backrest member makes it possible to simultaneously move the seat member and the backrest member simply by moving the weight of the user.

A further advantage of the invention is the simplicity of design of the connection mechanism comprising a male element and a female element that are fixedly joined, for example, to said seat member and to said backrest member, which are secured to one another via a simple joining mechanism that allows for play between the elements. Said play advantageously allows the backrest member to be inclined during the step in which the seat member slides.

In addition to the advantages listed, it is possible to appreciate how the simplicity of the connection mechanism makes it possible to obtain an adaptable collective seat that has a simple design and all of the characteristics required of collective seats: simple, light, compact, stackable, and inexpensive.

Lastly, said adaptable seat has the lower end of the backrest member in contact with the seat member. This configuration ensures that the lumbar region of the spine is supported, thus ensuring the user's comfort.

Preferably, the seat member and the backrest member are made of plastics material, whereas the frame of the seat, of metal material.

As a result of the sliding mechanism, the adaptable seat is capable of assuming two configurations: the rest configuration, in which the end of the seat member proximal to the backrest member abuts against the frame at the rear legs of the seat; and the activation configuration, in which the seat member slides along the axis y.

According to a preferred embodiment of the invention, the sliding mechanism comprises at least one resilient element which is suitable for moving the seat member back into its rest position without the intervention of external forces.

Said resilient element is preferably a spring.

The presence of the resilient element advantageously makes it possible to have a plurality of adaptable seats always in their rest configuration and ready to be stacked, when not in use. This prevents an operator from having to manually put the adaptable seats back into their rest condition in order to stack them, and gives a room in which a plurality of adaptable seats are used an uncluttered appearance.

BRIEF DESCRIPTION OF THE DRAWINGS

These features and the advantages associated therewith will become more apparent from the detailed description of some preferred embodiments of the invention, which will be illustrated, by way of non-limiting example, with reference to the accompanying drawings, in which.

DETAILED DESCRIPTION OF THE PREFERRED EMBODIMENTS

Figure 1:
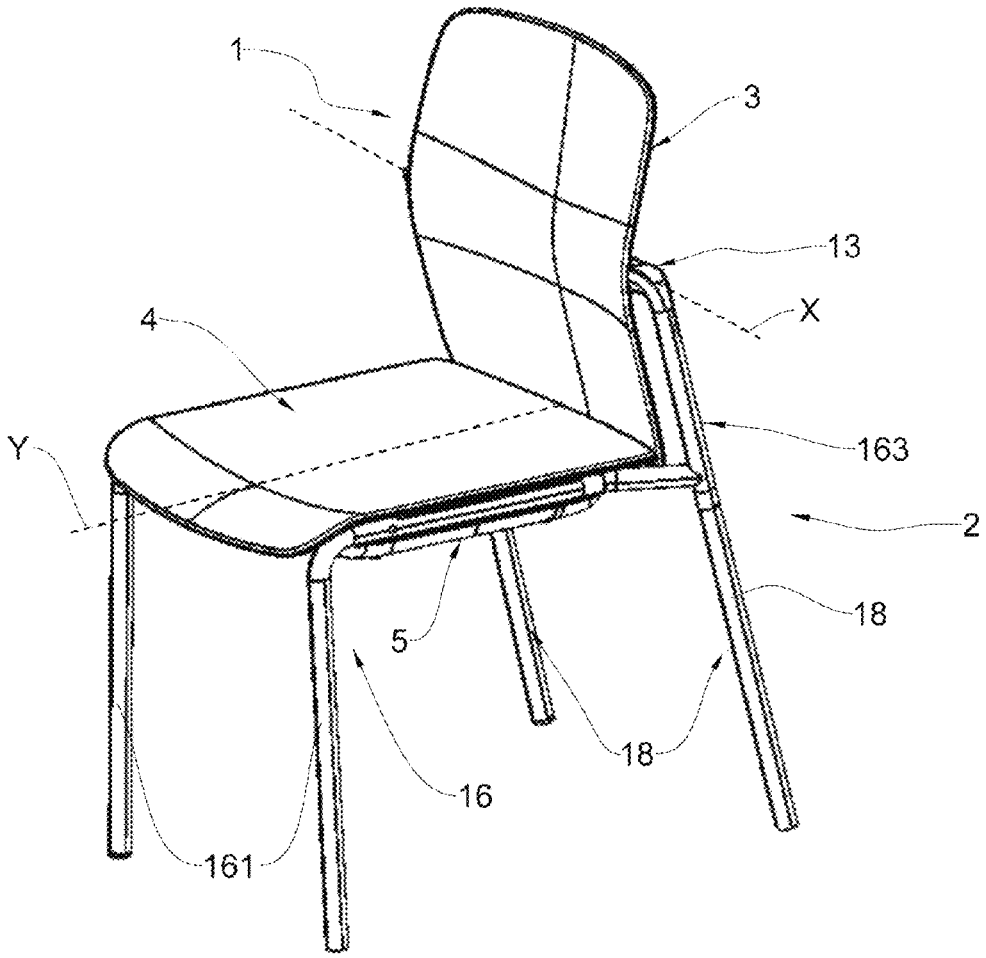
FIG. 1 is a perspective view of the adaptable seat that is the subject of the invention.

With reference to the figures, a preferred embodiment of an adaptable seat is shown, which seat is indicated as a whole by reference sign 1.

The adaptable seat 1 comprises a frame 2, a backrest member 3 and a seat member 4.

Figure 2:
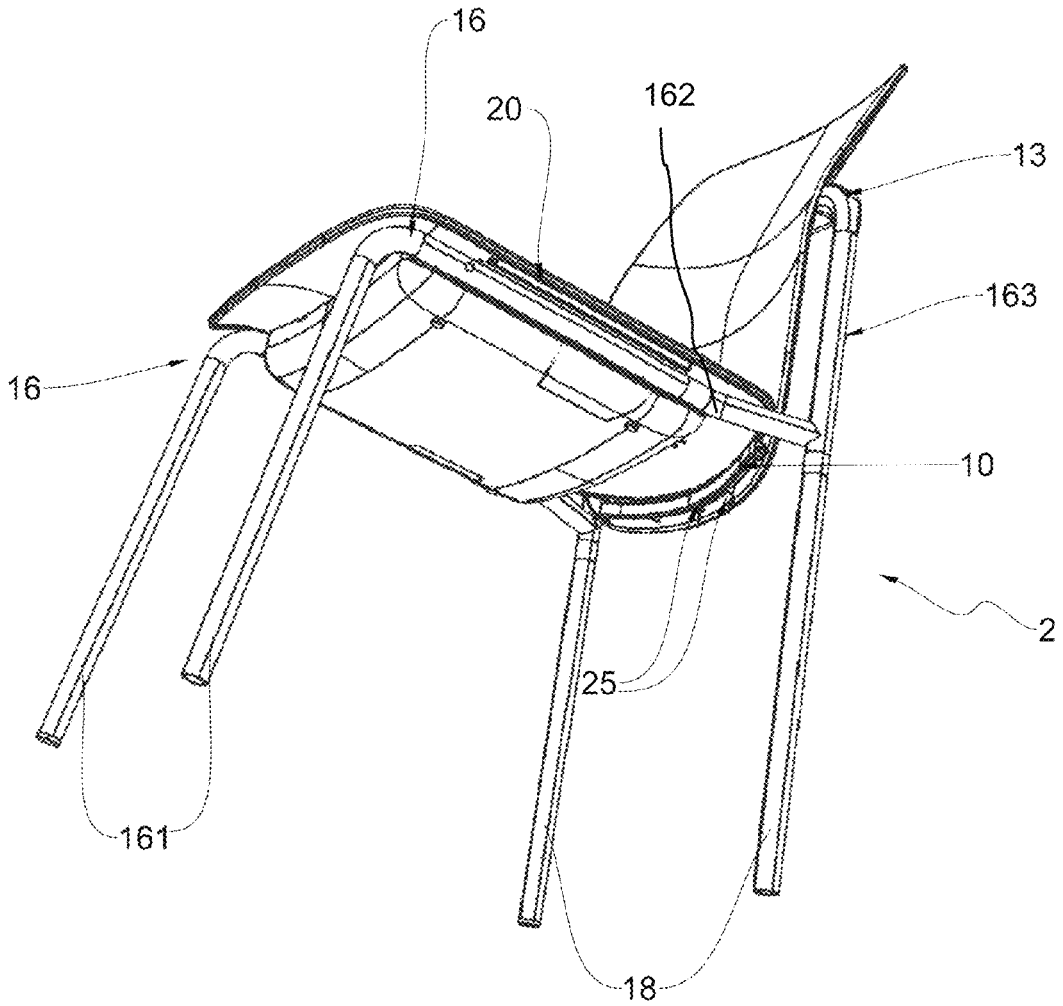
FIG. 2 is a different perspective view of the adaptable seat that is the subject of the invention.

With reference to FIG. 2, according to preferred embodiments, the frame 2 comprises two shaped portions 16 which define a front leg 161, a longitudinal element 162 and two vertical uprights 163 which define rear legs 18 of the seat 1.

The shaped portions 16, preferably at their longitudinal element 162, are preferably connected to one another by at least two transverse elements 17 on which the seat member 4 bears, in ways which will be described in greater detail in the following. The backrest member 3 is preferably hinged to the vertical uprights 163, in order to define a transverse element 13 which connects the two portions 16.

In some embodiments, said frame 2 consists of tubular elements.

The seat member 4 and the backrest member 3 are preferably made of plastics material and the frame is preferably made of metal material.

With reference again to FIG. 1, the backrest member 3 is rotatably connected to the frame 2 about a rotation axis x.

In some embodiments, the connection may be provided by a hinge joint between the backrest member 3 and the two vertical uprights 163. In this way, the backrest member 3, together with the relative joints, defines the further transverse element 163, thereby connecting the two vertical uprights 163.

However, it will be appreciated that, in some embodiments, an additional connection element may be present, which element is rotatable with respect to the uprights 18 and to which element the backrest member 3 is secured.

As may be seen in FIG. 1, the rotation axis x is preferably positioned in a region approximately equal to half the vertical extent of the backrest member 3. In other words, the rotation axis x is positioned in a vertically central region of the backrest member.

In this way, it is possible to achieve an inclination of the backrest member that is suitable for allowing the user to lean backwards for the vast majority of hypothetical situations, thus ensuring a high degree of flexibility of use.

Figure 3:
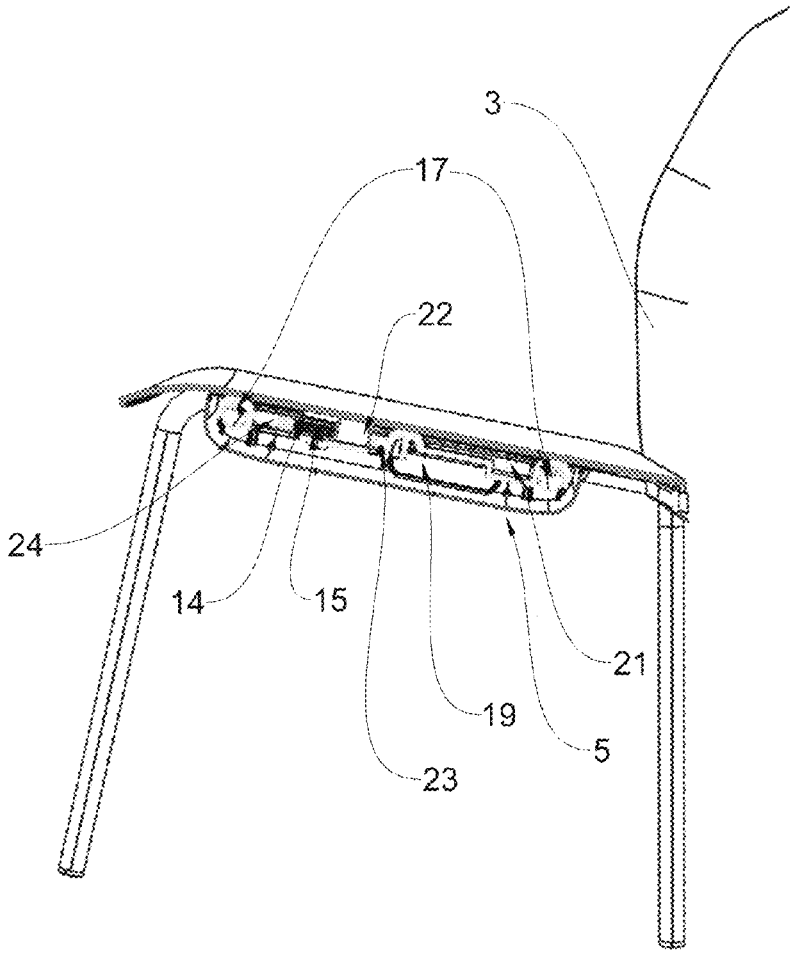
FIG. 3 is a sectional view of the adaptable seat that is the subject of the invention.
Figure 4:
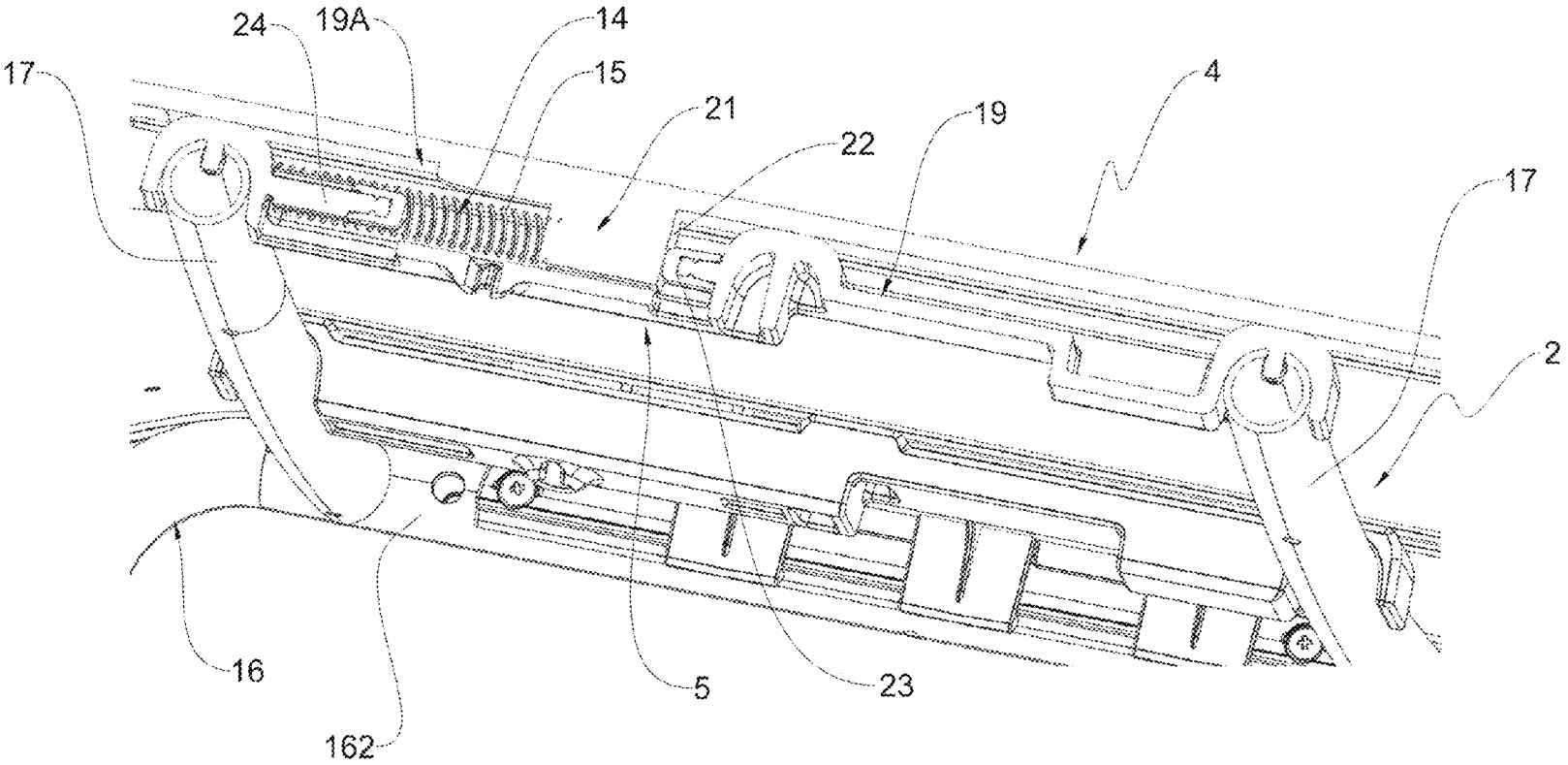
FIG. 4 is a detailed view of the section from FIG. 3, with a lower protective casing removed.
Figure 5:
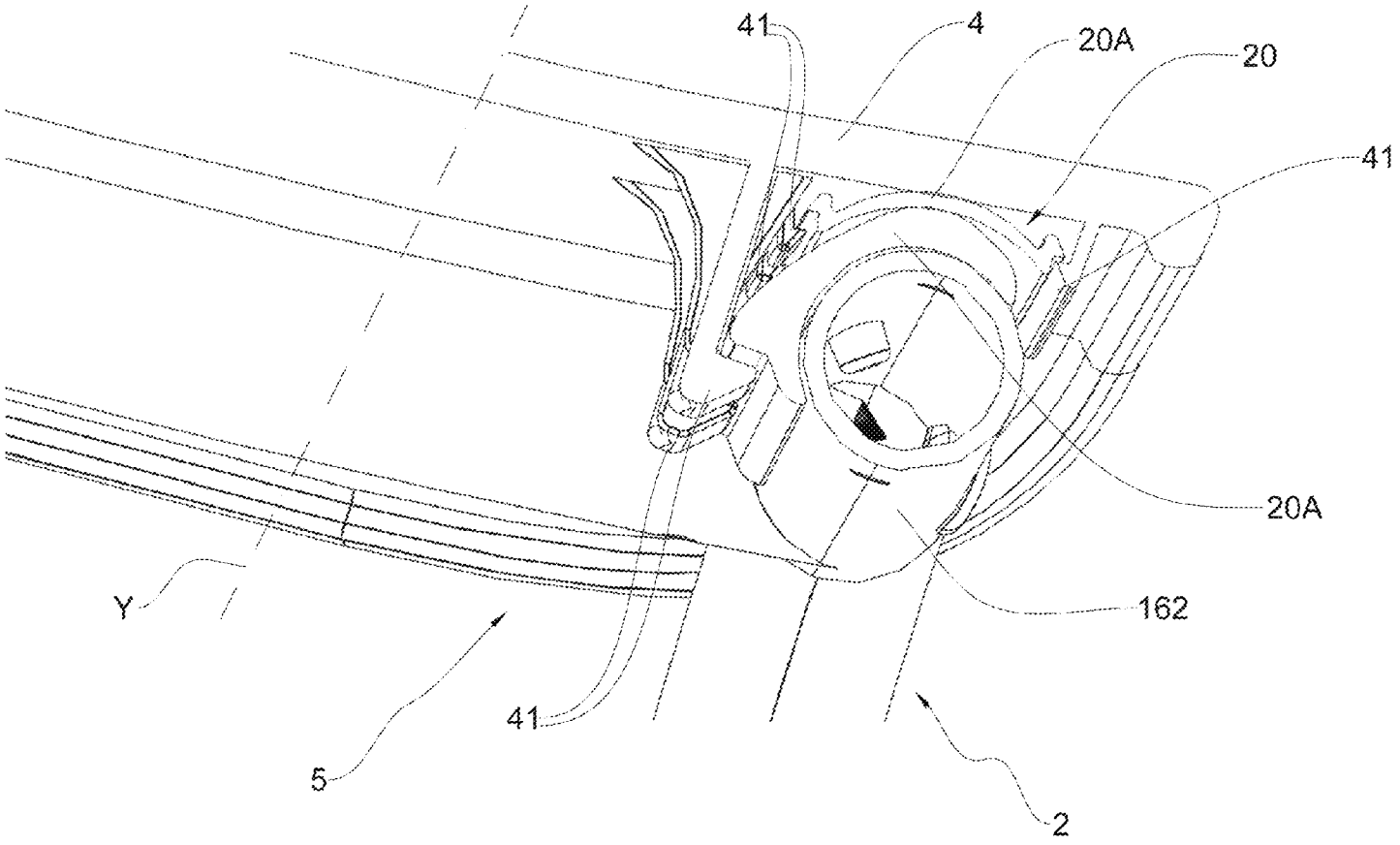
FIG. 5 is a further sectional view of the adaptable seat that is the subject of the invention, along a sectional plane perpendicular to that in FIG. 4, again without the protective casing.

With reference now also to FIGS. 3, 4 and 5, the seat member comprises a sliding mechanism 5 which includes at least one linear guide 20, the latter shown in FIG. 5, which connects the seat member 4 to the frame 2 and allows the movement thereof along a sliding axis y defined by the same linear guide 20.

Again with reference to FIG. 5, the linear guide 20 may be secured to the frame 2 at the longitudinal element 162.

The linear guide 20 may comprise a sliding element 20A, preferably two sliding elements, which is/are snap-fixed in a slidable manner on the seat member 4.

For this purpose, according to one aspect of the invention, a plurality of deformable coupling teeth 41 which are aligned along the sliding axis y may be provided in the seat member 4.

Each sliding element 20A may therefore have a contact surface which rests against a corresponding surface of the teeth 41, allowing the seat member 4 to slide along the axis y and, at the same time, keep it supported on the frame 2.

This solution advantageously allows the seat member to slide by means of a robust and easily implementable solution.

With particular reference now to FIG. 4, according to preferred embodiments, the sliding mechanism 5, in addition to the at least one linear guide 20, comprises at least one fixed track 19, preferably two, that is/are fixedly joined to the at least two transverse elements 17 of the frame 2 and positioned below the seat member 4.

The track 19 defines a sliding surface for the seat member 4 and, in preferred embodiments, comprises a cavity 19A in which a resilient element 14 is received.

The resilient element 14 may be oriented in the direction of the sliding axis y and may be positioned in a distal region with respect to the backrest member 3, as may be seen in the example shown in FIG. 3.

In order to allow the seat member 4 to slide on the runners, the sliding mechanism 5 may also comprise at least one guide, advantageously defined by the same cavity 19A. It should be noted that, in the embodiment shown in the figure in which two tracks are present, two guides are correspondingly provided.

The seat member 4 slides as a result of the presence of at least one runner 21 that is fixedly joined to the side of the seat member 4 facing the frame 2.

The guides defined by the cavities 19A are therefore advantageously suitable for receiving runners 21 on the portions facing the side of the seat member 4.

The runner or runners 21 may comprise a shaped element 22 which is inserted into the cavity 19A between the resilient element and a first end stop 23 that is fixedly joined to a side of the track proximal to the backrest member.

When an external force is applied to the seat member 4, the runners 21 may slide inside the guides of the tracks, thus creating the linear movement of the seat member along the axis y.

In so doing, it is possible to move the seat member 4 between two configurations: a rest configuration, in which the end of the seat member 4 proximal to the backrest member abuts against the frame 2 near the vertical uprights 163 of the adaptable seat 1; and an activation configuration, in which the seat member slides along the axis y and is spaced apart from the vertical uprights.

In preferred embodiments, the resilient element 14 is in the rest condition when the seat member 4 is in the rest configuration, and is under compression when the seat member 4 is in the activation configuration; therefore, one advantage of the invention is that the resilient element 14 makes it possible to move the seat member 4 back from the activation position into the rest position without the intervention of external forces.

Said resilient element 14 is preferably a spring 15.

A second end stop 24 may optionally be provided, which second end stop is fixedly joined to a side of the track 19 distal to the backrest member 3. In preferred embodiments, the spring 15, or more generally the resilient element 14, surrounds the second end stop 24.

It should also be noted that, in the embodiments described above, the linear guide may be secured in a sliding manner to the longitudinal elements 162 and, as described above, also be capable of retaining the seat member 4 in a manner supported on the frame 2. The fixed track 19 may instead be supported on the transverse elements 17. In this way, the return action provided by the spring and the support action of the seat member may be achieved by a separate component from the component which keeps the seat member on the frame, i.e. which prevents said seat member from being able to lift in particular while moving.

Figure 6:
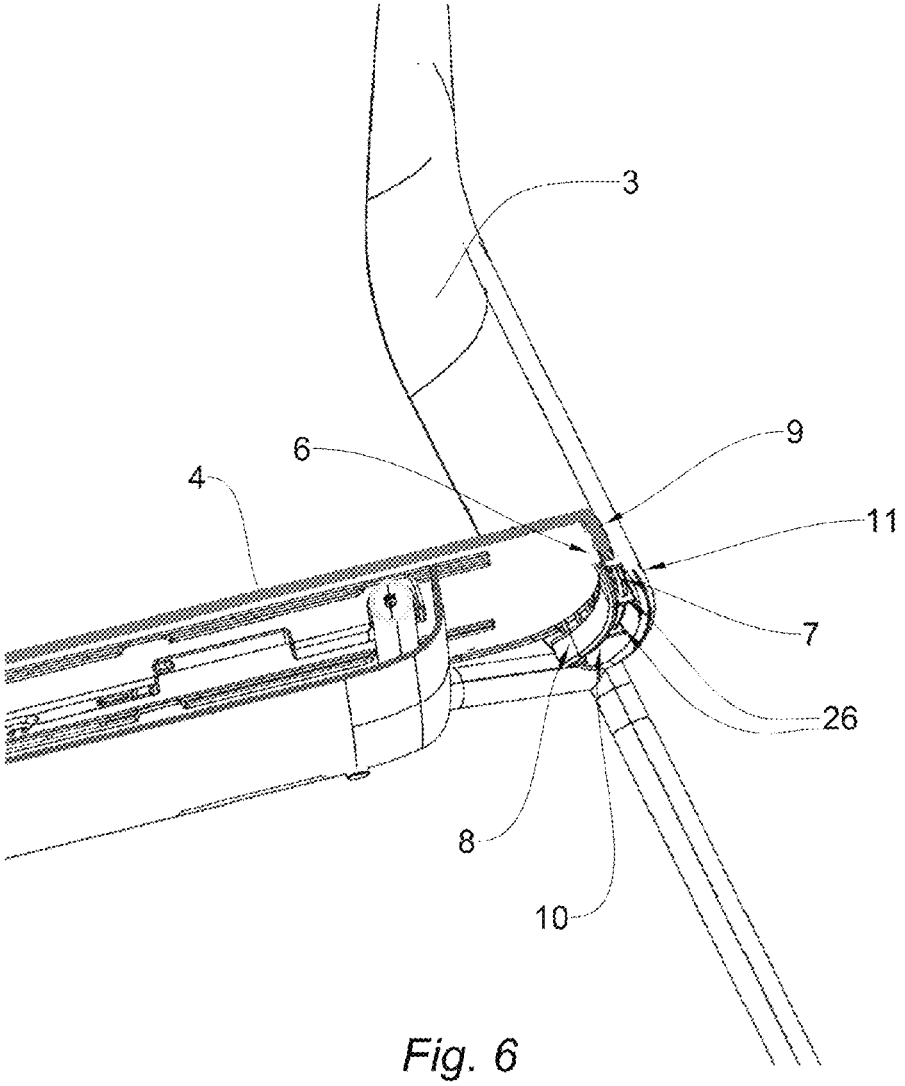
FIG. 6 is a sectional view, with an enlarged detail of the adaptable seat that is the subject of the invention.
Figure 7:
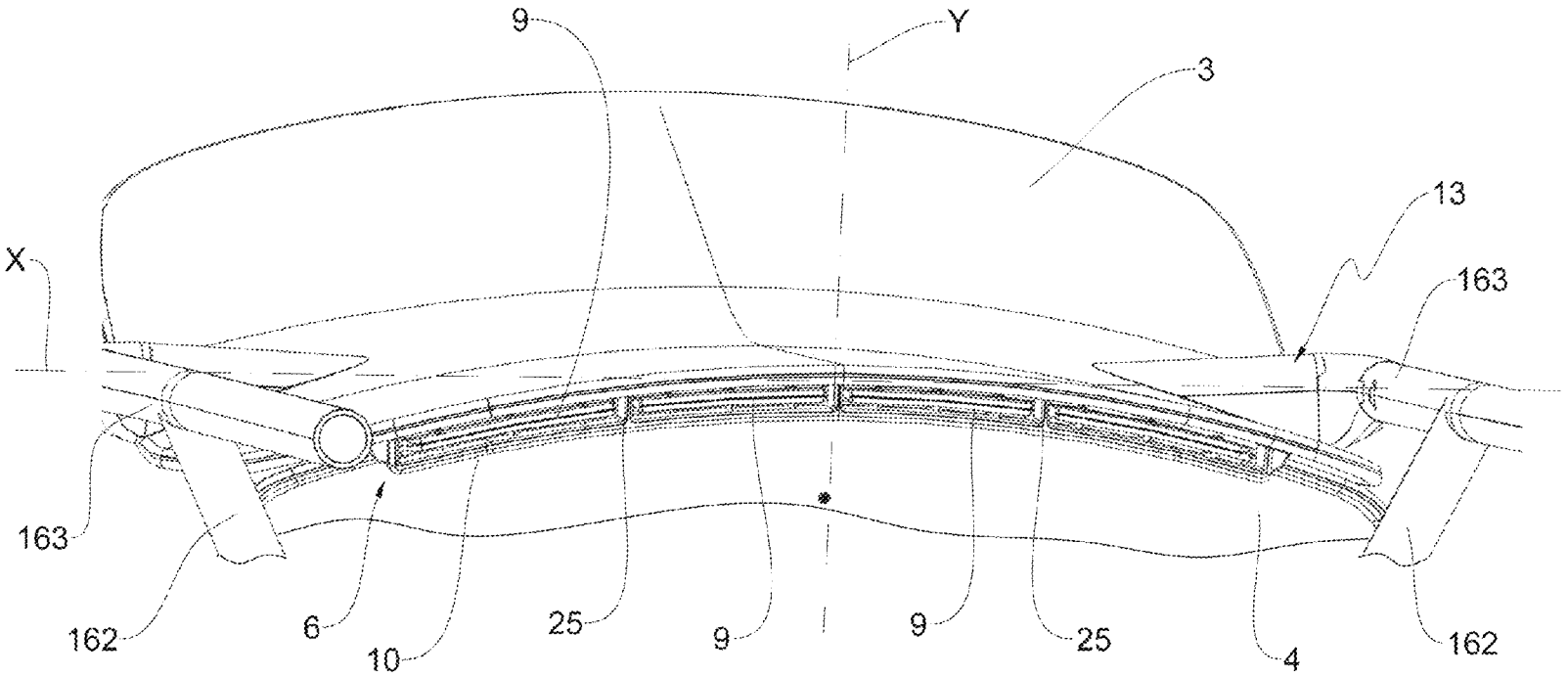
FIGS. 7 and 8 are a view from below and a relevant detail of a connection mechanism between the backrest member and the seat member of the adaptable seat of the present invention.
Figure 8:
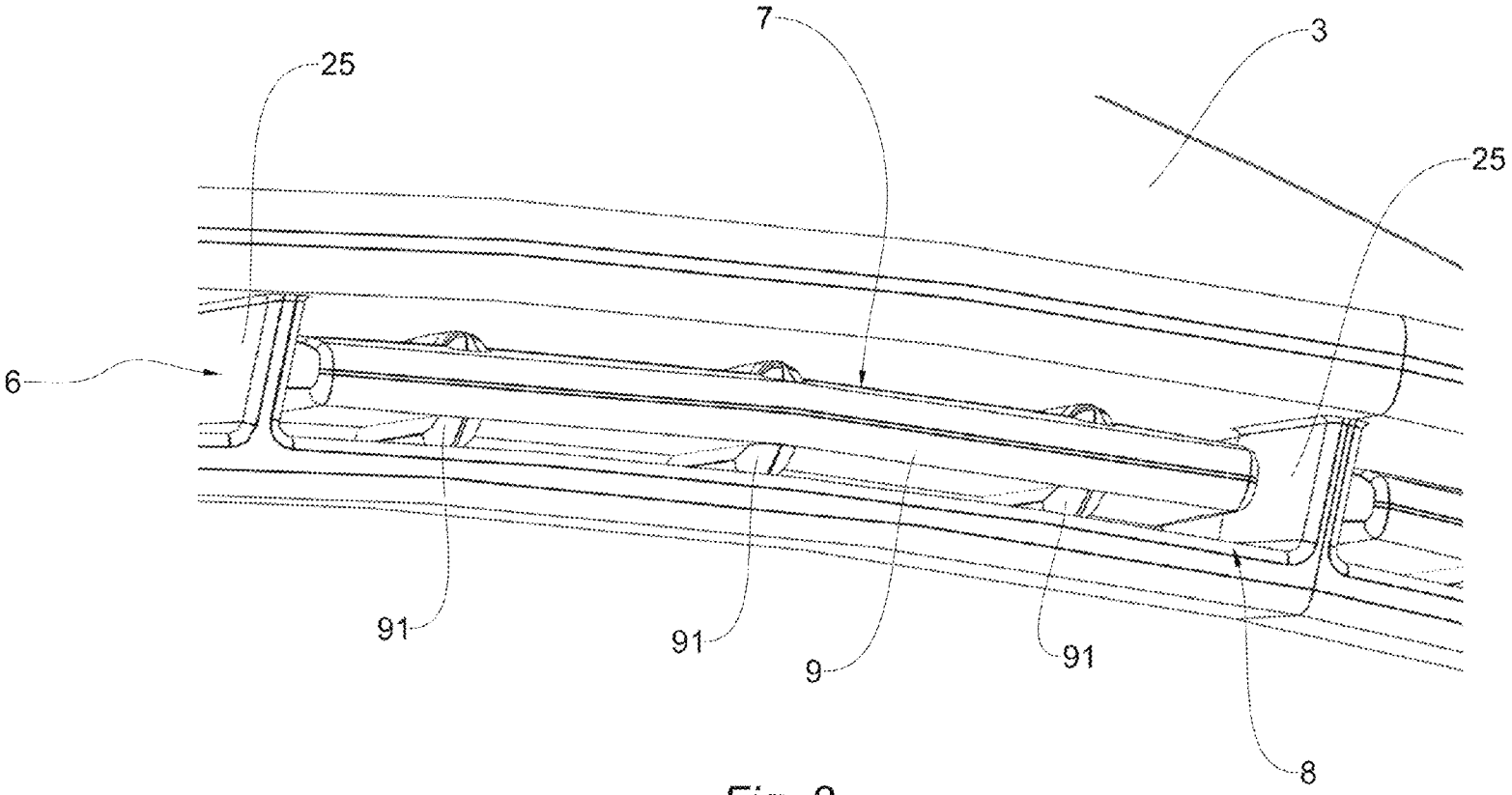

With reference now to FIGS. 6, 7 and 8, the adaptable seat 1 also comprises a connection mechanism 6 which connects said backrest member 3 to said seat member 4.

The connection mechanism 6 comprises a male element 7 and a female element 8 which are formed on the seat member 4 and on the backrest member 3, respectively, or vice versa, and which are capable of mutual engagement. As will be better shown in the following, the connection element 6 is configured in such a manner as to convert the rotation of the backrest member 3 about the rotation axis x into the sliding action of the seat member 4 along the sliding axis x, and vice versa. In other words, by means of the connection element, the movements of the seat member and backrest member are coordinated, and the user is able to act on the former and/or on the latter in order to switch from the first configuration to the second configuration. This is particularly advantageous in that it allows a more or less inclined sitting position that is optimal for the contingent situation to be obtained, by acting by means of a simple and natural movement of the body.

In fact, the user may pass from a position for frontal viewing to a position for raised viewing simply by moving their centre of gravity forwards. The movement of the weight causes the seat member 4 to move forwards along the axis x and, by moving, drags the lower end 11 of the backrest member 3, which, by rotating on the hinge joint, allows the user to recline the back and the neck by changing position.

In order to simplify the connection between the two male and female elements, these may advantageously engage with play.

For this purpose, in some embodiments, the male element 7 may comprise a projecting profile 9 which projects from the operating surface of the seat member 4 or said backrest member 3.

The female element 8 in turn comprises a pocket-like element 10 which is formed on the other of said seat member 4 and said backrest member 3 and is configured so as to receive the projecting profile 9.

According to preferred embodiments, the pocket-like element 10 is formed near the lower end 11 of the backrest 3, adjacent to the end thereof that is proximal to the seat member 4.

The projecting profile 9 may in turn be formed near the end of the seat member 4, adjacent to the end proximal to the backrest member 3, on the side of the seat member 4 facing the frame 2.

As may be better seen in FIG. 8, the projecting profile 9 is inserted into the pocket-like element 10, thus securing the seat member 4 and the backrest member 3 so as to allow the inclination of the backrest 3 to be adapted in a simultaneous and coordinated manner with the sliding action of the seat member 4 along the axis y, as described above.

The projecting profile 9 is preferably perpendicular to the seat member 4.

In order to ensure the correct positioning of the projecting profile 9 and, at the same time, allow the required relative movement between the male element and female element, the projecting profile 9 may comprise thickening elements 91 which are also received in said pocket 10. The projecting profile 9 is preferably received in said pocket 10 with greater play than said thickening elements 91. In some embodiments, the thickening elements 91 are substantially in contact with walls of said pocket 10.

In so doing, the engagement between the pocket 10 and the projecting profile 9 is maintained; however, at the same time, the inclination of the backrest member 3 in the activation configuration of the seat member 4 is permitted by utilising the deformation of the walls of the pocket-like element 10 and/or the thickening elements 91.

In some embodiments, the projecting profile 9 and the pocket 10 have an elongate shape and extend at an outer edge of the seat member 4 and the backrest member 3, respectively.

The pocket-like element 10 may optionally be divided internally by reinforcement baffles 25 between the backrest member 3 and the wall of the pocket-like element 10 that is distal to the backrest member 3; therefore, in this configuration, the projecting profile 9 is divided vertically along its length, i.e. along its direction of longitudinal extension.

In so doing, a robust connection may be provided, which at the same time guarantees the flexibility necessary for allowing the relative movement of the seat member and backrest member.

In preferred embodiments, the projecting profile 9 extends underneath the seat member 4, and the backrest member is configured so as to extend partially beneath the seat member.

In this way, the pocket 10 may be formed at the lower end of the backrest member, near the lower edge of the same, so as to also be positioned beneath the seat member.

This makes the connection system less visible when the seat is in use.

A person skilled in the art, in order to satisfy further contingent needs, may make numerous modifications and variations to the adaptable seat 1 described above, which modifications and variations are all contained within the scope of protection of the present invention as defined in the accompanying claims.

The invention claimed is:

1. An adaptable seat comprising a frame, a backrest member and a seat member, said backrest member being rotatably connected to the frame about a rotation axis wherein said seat member comprising a sliding mechanism which includes at least one linear guide which connects the seat member to the frame and allows said seat member to move along a sliding axis which is defined by said linear guide, said adaptable seat further comprising a connection mechanism which connects said backrest member to said seat member, said connection mechanism comprising a male element, divided vertically along a direction of longitudinal extension thereof, and a female element which are formed on said seat member and said backrest member, respectively, or vice versa, and which are configured for mutual engagement in such a manner as to convert a rotation of the backrest member about the rotation axis into a sliding action of the seat member along the sliding axis, and vice versa and wherein said male element comprises an elongated profile projecting from an operating surface of said seat member, and said female element comprising an elongated seat formed on the backrest member and being configured so as to receive said projecting profile.

2. The adaptable seat according to claim 1, wherein the male element and the female element mutually engage with play.

3. The adaptable seat according to claim 1, wherein one of said male element or said female element is formed near an end of the seat member that is proximal to the backrest member, on a side of the seat member facing the frame.

4. The adaptable seat according to claim 1, wherein one of said male element or said female element is formed proximate to a lower end of the backrest member.

5. The adaptable seat according to claim 4, wherein said elongated seat is formed near the lower end of the backrest member.

6. The adaptable seat according to claim 1 wherein said male element is inserted into said female element, thus securing said seat member to said backrest member so as to allow an inclination of the backrest member to be adapted in a simultaneous and coordinated manner with the sliding action of the seat member along the sliding axis.

7. The adaptable seat according to claim 1, wherein said projecting profile is formed proximate to an end of the seat member that is proximal to the backrest member, on a side of the seat member facing the frame, the side being opposite to a seating surface of the seat member.

8. The adaptable seat according to claim 1, wherein the projecting profile is substantially perpendicular to the seat member.

9. The adaptable seat according to claim 1, wherein said rotation axis is positioned in a region of the backrest member that is arranged centrally along a direction of vertical extent thereof.

10. The adaptable seat according to claim 1, wherein the sliding mechanism comprises at least one resilient element configured to move the seat member back from an activation position to a rest position without intervention of external forces.

11. The adaptable seat according to claim 10, wherein the at least one resilient element comprises a spring.

12. The adaptable seat according to claim 1, wherein the sliding mechanism comprises at least one fixed track which defines a cavity inside which a runner which is fixedly joined to said seat member can slide.

13. The adaptable seat according to claim 12, wherein said frame comprises longitudinal elements and transverse elements, said linear guide being secured in a slidable manner to said longitudinal elements and being configured so as to retain said seat member in a manner supported on said frame, and said fixed track being supported on said transverse elements.

14. The adaptable seat according to claim 1, wherein said linear guide comprises at least one sliding element, connected to said frame and snap-fixed in a slidable manner on said seat member.

15. An adaptable seat comprising a frame, a backrest member and a seat member, said backrest member being rotatably connected to the frame about a rotation axis, said seat member comprising a sliding mechanism which includes at least one linear guide which connects the seat member to the frame and allows said seat member to move along a sliding axis which is defined by said linear guide, said adaptable seat further comprising a connection mechanism which connects said backrest member to said seat member, said connection mechanism comprising a male element and a female element which are formed on said seat member and said backrest member, respectively, or vice versa, and which are configured for mutual engagement in such a manner as to convert a rotation of the backrest member about the rotation axis into a sliding action of the seat member along the sliding axis, and vice versa, wherein said linear guide comprises at least one sliding element, connected to said frame and snap-fixed in a slidable manner on said seat member, and wherein said seat member comprises a plurality of deformable coupling teeth, which are aligned along the sliding axis, configured so as to allow said sliding element to be snap-fixed.

16. The adaptable seat according to claim 1, wherein said male element and said female element have an elongate shape and extend at an outer edge of said seat member and said backrest member, respectively, or vice versa.

17. An adaptable seat comprising a frame, a backrest member and a seat member, said backrest member being rotatably connected to the frame about a rotation axis, said seat member comprising a sliding mechanism which includes at least one linear guide which connects the seat member to the frame and allows said seat member to move along a sliding axis which is defined by said linear guide, said adaptable seat further comprising a connection mechanism which connects said backrest member to said seat member, said connection mechanism comprising a male element and a female element which are formed on said seat member and said backrest member, respectively, or vice versa, and which are configured for mutual engagement in such a manner as to convert a rotation of the backrest member about the rotation axis into a sliding action of the seat member along the sliding axis, and vice versa, wherein said female element is divided internally by reinforcement baffles, said reinforcement baffles extending between said backrest member and an internal wall of said female element that is distal to the backrest member.

18. The adaptable seat according to claim 1, wherein said male element extends underneath said seat member.

19. The adaptable seat according to claim 18, wherein said female element is formed at a lower end, when in use, of said backrest member, near a lower edge of said backrest member, such that said female element is located, when in use, underneath said seat member.

20. The adaptable seat according to claim 1, wherein said backrest member is configured so as to extend partially beneath said seat member.

21. The adaptable seat according to claim 1, wherein said projecting profile comprises at least one thickening element which is received in said elongated seat, said projecting profile being received in said elongated seat with greater play than said at least one thickening element.

22. The adaptable seat according to claim 21, wherein said at least one thickening element is substantially in contact with walls of said elongated seat.

* * * * *